United States Patent [19]

Brenner, Jr.

[11] 4,045,971

[45] Sept. 6, 1977

[54] FROST DETECTOR

[75] Inventor: George John Brenner, Jr., Kirkwood, Mo.

[73] Assignee: Emerson Electric Co., St. Louis, Mo.

[21] Appl. No.: 662,376

[22] Filed: Mar. 1, 1976

[51] Int. Cl.[2] ..... F25D 21/02

[52] U.S. Cl. ..... 62/140; 73/17 A; 340/234

[58] Field of Search ..... 62/139, 140, 151; 340/234, 222, 417; 73/17 A

[56] References Cited

U.S. PATENT DOCUMENTS

| | | | |
|---|---|---|---|
| 2,297,370 | 8/1942 | Siedle | 62/139 |
| 2,355,014 | 8/1944 | Schorn | 62/140 |
| 2,377,926 | 6/1945 | Dreier | 62/140 |
| 2,466,696 | 4/1944 | Friswold et al. | 73/17 A |
| 3,066,496 | 12/1962 | Jokela | 62/140 |
| 3,120,108 | 2/1964 | Pansing | 62/140 |
| 3,188,828 | 6/1965 | Wayne | 62/140 |
| 3,362,183 | 1/1968 | Sutton | 62/140 |
| 3,822,560 | 7/1974 | Hansen et al. | 62/151 |
| 3,946,286 | 3/1976 | Kinnunen et al. | 62/151 |
| 3,961,495 | 6/1976 | Beauvent et al. | 62/140 |

*Primary Examiner*—William E. Wayner
*Assistant Examiner*—Robert Charvat
*Attorney, Agent, or Firm*—Polster, Polster and Lucchesi

[57] ABSTRACT

A frost sensor for detecting the presence of frost in a refrigeration device includes a light impervious enclosure having an air passage through it. Means preferably are provided for directing ambient air through the air passage. The air passage has thermal conducting means mounted in it, the thermal conducting means having a first surface forming a portion of the air passage. A connection device also is provided for attaching the conducting means to the refrigeration device. A photocell and a light source are mounted so that the photocell senses reflectivity of the conductive means. The volume of ambient air passing through the air passage and the thermal resistance between the conducting means and the refrigeration device may be varied so that the formation of frost on the conducting means can be made to agree with the formation of frost on the refrigeration device.

14 Claims, 4 Drawing Figures

FROST DETECTOR

BACKGROUND OF THE INVENTION

This invention relates to defrosting control devices, and more particularly, to an improved frost sensor used to control the defrost cycle of a refrigeration device. While the invention is described with particular emphasis on air conditioning applications, those skilled in the art will recognize the wider applicability of the inventive concepts disclosed hereinafter.

Refrigeration systems, particularly the evaporator coils of air conditioning equipment and the like, are susceptible to frost accumulation during operation. Frost accumulation is undesirable in that it decreases the cooling efficiency of the system, and raises operating costs. Even though its deficiencies are well known, frost accumulation and the related problem of detection have plagued refrigeration systems for a long time, and a number of methods and devices have been proposed to control removal of the frost. For example, timers often are employed to initiate a defrost cycle after some elapsed time period. Mechanical counters have been utilized in certain domestic appliances to initiate a defrost cycle after some preset number of door openings on the appliance. Photoelectric ice detecting devices also have been proposed for frost detecting purposes. The photoelectric detecting devices in general operate by causing radiant energy from a light source to be reflected, scattered, refracted or otherwise transmitted from the radiant energy source to a sensor, the amount of radiant energy transmitted in turn being dependent upon the frost or ice build-up on a particular surface.

While these prior art devices work well for their intended purposes, they all may be characterized as operating on symptoms of frost rather than the true frosting condition of the evaporator coil. That is to say, prior art devices have not provided detectors which are capable of close simulation of the frosting characteristics or conditions in the evaporator coil that the frost detector was intended to sense. Consequently, prior art sensors often initiate defrost cycles when that cycle is not needed, a procedure known in the art as a "false" defrost cycle. False defrost cycles decrease system efficiency, which tends to defeat the very purpose of the frost detector. Although the invention disclosed hereinafter employs a photocell as the actual sensing device, the total sensor construction is distinguishable from prior art frost detectors employing photocell devices in that the sensor of the invention accumulates frost exactly as the evaporator coil accumulates frost so that the defrosting cycle is initiated only when required for efficient evaporator operation. In addition, the same detector that initiates the defrost cycle also is used to terminate the defrost cycle. The elimination of false defrost cycles in the refrigeration system results in increased overall system efficiency and decreased operating costs. Use of the same detector to terminate defrost ensures that the defrost cycle actually is completed before normal operation is again undertaken.

One of the objects of this invention is to provide an improved frost sensor for detecting the presence of frost.

Another object of this invention is to provide a frost sensor in which the formation of frost is analogous to the formation of frost in the refrigeration unit with which the sensor finds application.

Another object of this invention is to provide a low-cost frost detector for a refrigeration unit.

Still another object of this invention is to provide a frost detector in which factors affecting frost accumulation in the sensor may be varied.

Another object of this invention is to provide a detector for a refrigeration unit that controls both the activation and de-activation of a defrost cycle for the system.

Another object of this invention is to provide a frost detector having an air passageway through it which uses the pressure drop across the evaporator coil of a refrigeration system to draw air through the passageway.

Other objects will be apparent to those skilled in the art in light of the following description and accompanying drawings.

Summary of the Invention

In accordance with this invention, generally stated, a frost detector is provided for controlling a defrosting cycle of a refrigeration device which eliminates false frost detection activation of the device. The preferred embodiment includes a housing having an air passage through it. Thermally conductive means are provided which have a first surface exposed in the air passage, and a second surface thermally connected to the refrigeration device. The frost detector construction is adapted to permit the variation both of air volume through the air passage and thermal resistance at the interface between the thermally conductive means and the refrigeration device. Variability of air flow and thermal resistance permits the adjustment of frost formation on the first surface of the thermally conductive means so that it follows frost formation in the refrigeration device closely. A photocell and light source are utilized to sense frost formation in the device and to initiate a defrost cycle when formation of frost inhibits the efficiency of the refrigeration device. The photocell and light source also terminate the defrost cycle by sensing frost removal.

Description of the Preferred Embodiment

Figure 1:
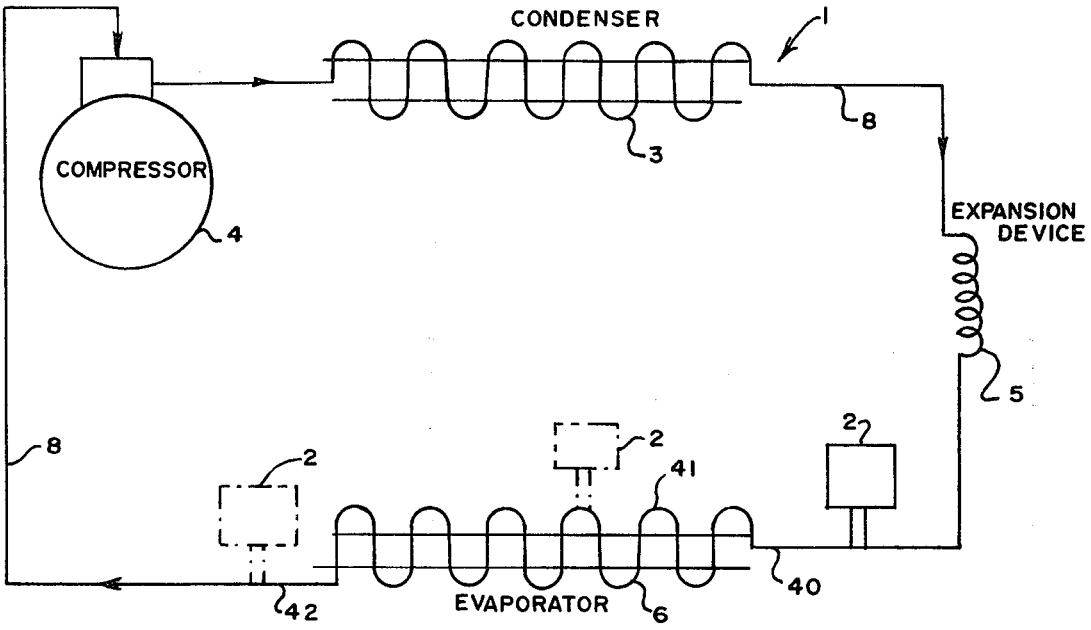
FIG. 1 is a diagrammatic illustration of a refrigeration system in which the defrost detector of this invention finds application.

Referring now to FIG. 1, reference numeral 1 indicates a refrigeration system employing one illustrtive embodiment of frost detector 2 of this invention. The particular refrigeration system shown in FIG. 1 icludes a compressor 4, a condenser 3, an appropriate expansion device 5, and an evaporator coil 6, which are interconnected to one another and to the compressor 4, through a conduit system 8. The coil 3 is an outdoor coil for condensing the compressor refrigerant, and the coil 6 is an inside coil for refrigerating the interior of an enclosure, such as a room or other space. Refrigeration systems of the type just described are well known.

A suitable refrigerant or brine is circulated through the system 1 in the direction of the arrows shown in FIG. 1 by the compressor 4, which conventionally includes a dynamoelectric machine, not shown, as its drive source. The coil 6 has an inlet 40 leading to a main body portion 41 and an outlet 42 arranged in a conventional manner. The frost detector preferably is positioned upstream of the coil 6, for example, between the inlet 40 and the expansion device 5. Alternative postions include detector 2 mountings along the main body portion 41 and along the outlet side 42 of the coil 6, the alternative positions being shown by phantom outlines in FIG. 1. While such other locations for the detector 2 are acceptable, I have found that a location upstream of the inlet 40 usually permits simple installation, ease in adjusting detector 2 operation, and ease in servicing the detector 2.

The detector 2 includes a housing 9 having an air passageway 10 extending through it. The passageway 10 has an inlet 11 and an outlet 12 offset from a test portion 13 of the passageway 10, best seen in FIG. 3. The offset provided between the inlet 11-outlet 12 and the test portion 13 ensures that the portion 13 is substantially impervious to light from sources external of the frost detector 2. The housing 9 generally has a rectangular silhouette which includes an exterior side wall 14 having an opening 15 through it. The test portion 13 is defined in part by a wall 31. A target plate 16 is sized for reception in the opening 15. The target plate 16 and housing 9 may be interconnected by any convenient method. An epoxy or other adhesive bond works well, for example.

Target plate 16 has a first surface 17 defining a part of the test portion 13 of the passageway 10. Target plate 16 is constructed from a heat conductive material, brass or copper working well, for example. The target 16 has a second surface 18 having a groove 19 formed in it. The groove is designed to receive a portion of conduit system 8 of the refrigeration system 1, as described in greater detail hereinafter. The target 16 also has a pair of openings 20 formed on the surface 18 side of it, which are designed to receive a pair of conventional fasteners 21. The fasteners 21 and a plate 22 define a fastening means 23, later described in greater detail. A lip 24 extends outwardly from the plate 17 on the surface 18 side of the plate. The lip 24 abuts and overlaps the wall 14 in the intermounted position of the plate 16, thereby facilitating the attachment of the plate to the housing 9 described above.

The housing 9 also has a cavity 25 formed in it, which is designed to receive and house an electronic circuit control means, indicated generally by the numeral 26. The control means 26 includes a source of radiant energy 27 and a detector 28 mounted in an assembly head 29 and positioned so that the detector 28 will receive radiant energy reflected from the surface 17 of the target plate 16 upon the occurrence of some predetermined frost condition on the surface 17.

The assembly head 29 may comprise a variety of suitable materials for receiving the source 27 and detector 28. The assembly head 29 preferably is positioned in an opening 30 formed in the wall 31, the opening 30 being located so that the opening communicates with the cavity 25. The assembly head 29 closes the opening 30 in the assembled form of the detector 2. Again, interconnection between the head 29 and the housing 9 may be accomplished by any convenient method.

The electronic control circuit means 26 is constructed from conventional components, and is not described in detail. In general, it may comprise a suitable circuit arrangement which will energize a defrost cycle for the refrigeration system 1 upon the occurrence of some predetermined frost condition on the plate 17 of the target plate 16, and institute normal operation of the system 1 when frost removal is complete. As frost begins to accumulate on the plate 16, the amount of light reflected from the face 17 increases appreciably until the detector 28 receives sufficient energy for energization. Output of the detector 28 is utilized to initiate a defrost cycle for the system 1. Likewise, as defrosting occurs, the amount of light reflected from the face 17 decreases until the detector 28 receives insufficient energy for energization. At that point, normal system 1 operation is resumed. The use of a single sensor for initiation of both defrost and normal operation cycles is an important distinction between my invention and prior art devices.

The inlet 11 of the air passage 10 has a flexible duct means 32 attached to it in a conventional manner. The duct means 32 is used to obtain inlet air from the source of air for the coil 6. That is, the air input to the passageway 10 preferably is the same as the air input to the coil 6. The outlet 12 of the detector 2 is positioned on a side of the coil 6 opposite the inlet 11, so that the air pressure drop across the coil 6 may be used to draw air through the duct 32 and the passageway 10. This relationship is important, as it ensures that air passing through the test portion 13 necessarily is at the same temperature and moisture content condition as the air passing over the coil 6.

Figure 4:
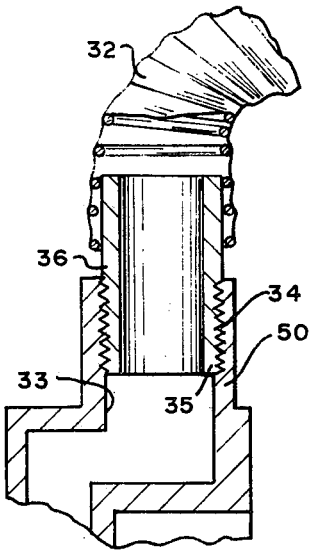
FIG. 4 is a view in cross section, partly broken away, of a modified inlet for the frost detector shown in FIG. 3.

Referring now to FIG. 4, a modification in the inlet of the device 2 is illustrated. As there shown, an inlet 50 includes an internal wall 33 which defines the inlet opening, the wall 33 having a threaded portion 34 formed in it. The inlet 50 is sized to receive an adapter 36 having a threaded wall 35 forming at least a portion of the external side wall of the adapter. The duct means 32 is attached either to the adapter 36 or to the inlet 50 in a conventional manner. The inlet 50 shown in FIG. 4 is the preferred form of the inlet for the device 2 in that it permits easy adjustment of the air input to the passageway 10 merely by insertion or removal of various adapters compatible with the inlet 50. Other adapter constructions are compatible with the broader aspects of this invention. For example, the housing 9 may have a threaded opening in it, which receives a complimentary threaded fitting. The fitting, in turn, may define the inlet 11, the axial opening through various fittings being varied to permit control of air volume entering the passageway 10.

An insulative means 37 also is provided, which functions to vary the thermal contact between the conduit 8 of the refrigeration system 1 and the target plate 16. That is to say, the insulative means 37 is placed over that portion of the conduit 8 where detector 2 attachment is desired. The thickness of the insulative means 37 varies the thermal resistance at the interface between the duct 8 and the plate 16. Insulative means 37 may comprise a variety of materials. For example, insulation available from the E. I. duPont de Nemours and Company under the trademark "Mylar," works well for this purpose.

It is thus evident that the conditions existing in the test portion 13 of the air passage 10 may be varied to match the conditions existing in the coil 6. That is to say, the temperature of the plate 16 at the surface 17 may be varied by using the insulative means 37 so that it follows the temperature in the evaporator coil 6 closely, while air flow through the passageway 10 may be varied using the adapter 36, so that the air flow condition in the test portion 10 follows the air flow condition in the evaporator 6 closely. Ability to vary temperature and air flow through the passageway 10 means that the detector 2 of my invention may be matched with the evaporator coil 6 so that frost forms on the surface 17 in a manner analogous to the formation of frost on the coil 6. This is an important distinction between my invention and prior art devices because the circuit means 26 is energized by the detector 28 only when a certain selected frost condition occurs on the surface 17. That frost condition closely matches the condition of frost in the evaporator coil 6.

Figure 2:
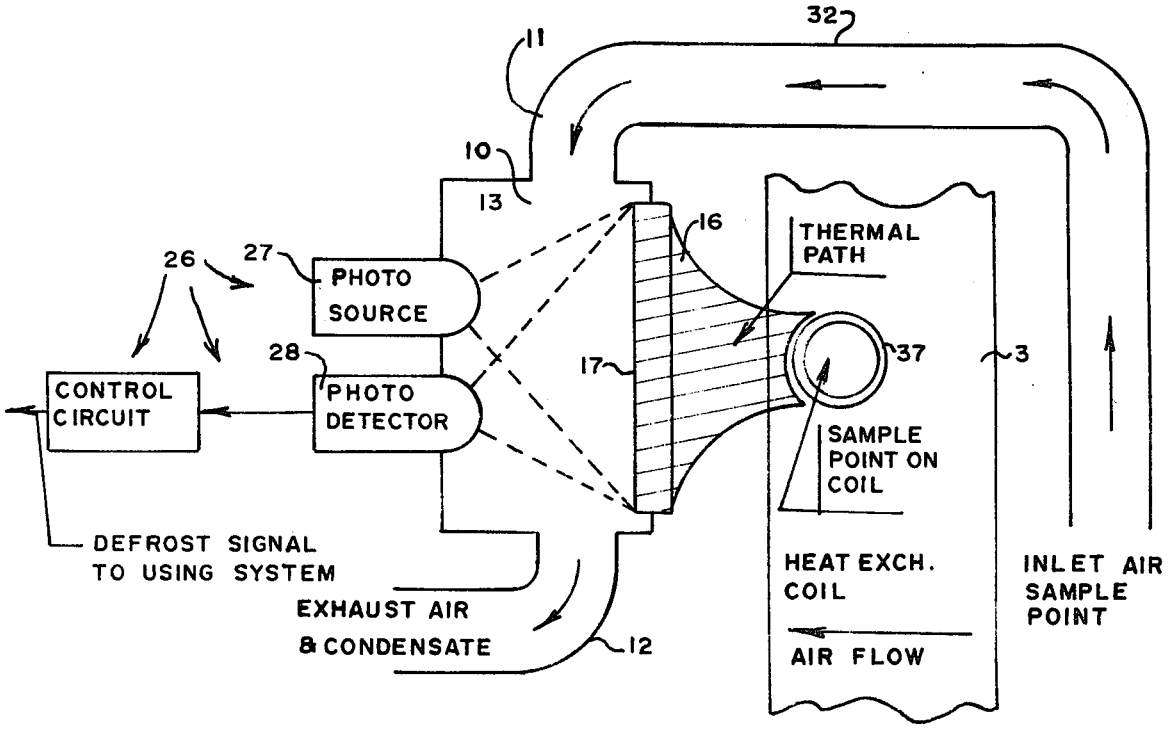
FIG. 2 is a diagrammatic illustration of the frost detector of this invention.
Figure 3:
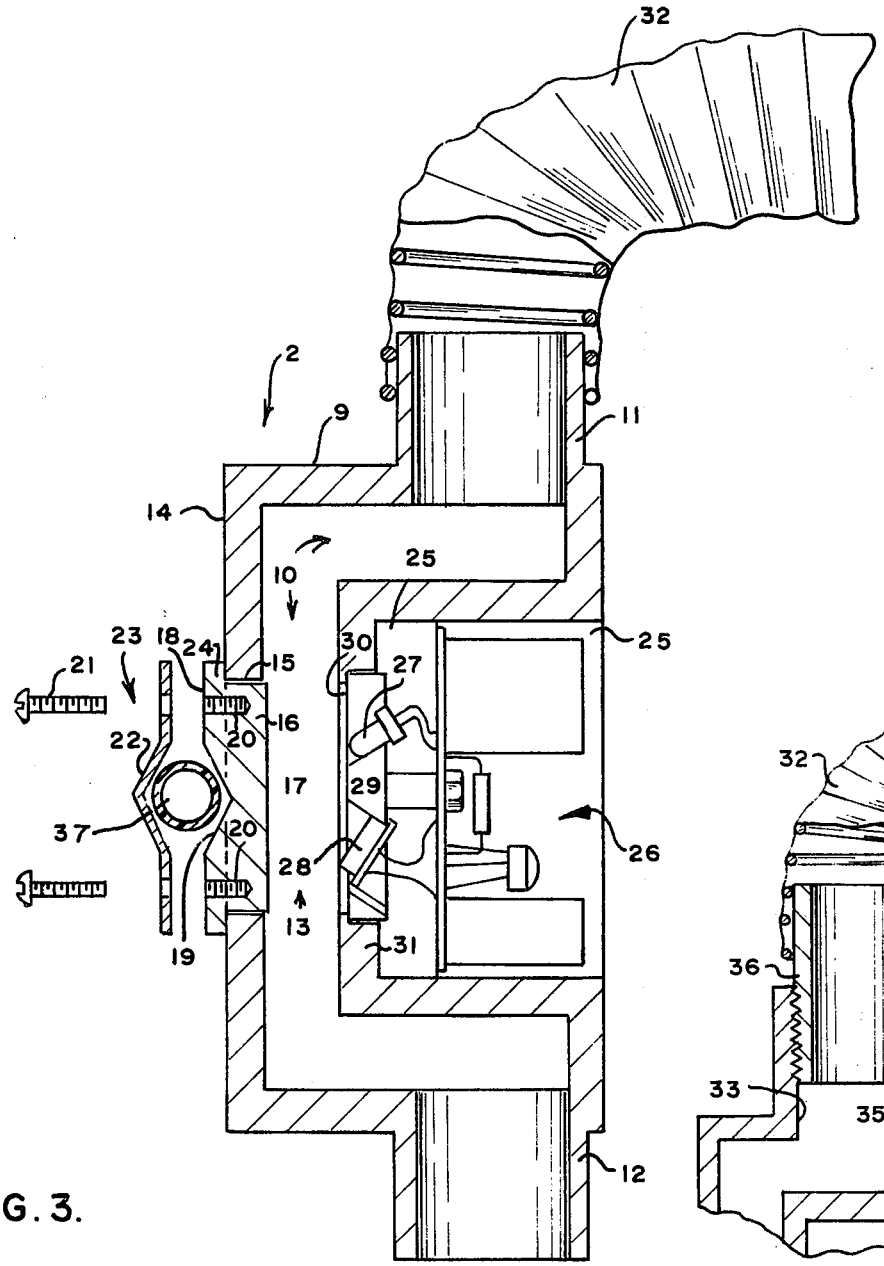
FIG. 3 is a view in cross section of one illustrative embodiment of frost detector of this invention.

Operation of the detector of this invention is relatively simple to understand, particularly when referenced to FIGS. 2 through 4. As indicated above, the duct 32 is positioned so that inlet air to the passageway 10 is obtained from the inlet air side of the coil 6. Since the inlet air has approximately the same temperature and moisture content as the air passing over the coil 6, adjustment of the conditions present in the test portion 13 will permit the detector 2 to form frost on the surface 17 in a manner analogous to the formation of frost in the coil 6. This is accomplished by varying the air input to the test portion 13 and by variation of the temperature of the plate 16 through the use of the insulative means 37. In the embodiment illustrated, the radiant energy source 27 is energized and directs radiant energy towards the surface 17. The surface 17 preferably is non-reflective, so that the radiant energy normally is absorbed by the surface 17 and the walls of the housing 9 defining the air passageway 10. As frost forms on the surface 17, the amount of energy reflected by the surface 17 increases until that amount reaches a predetermined level. At that predetermined level, the detector 28 initiates an output signal for commencing defrost operation. Since defrosting may be accomplished merely by reversing the refrigeration cycle, the increased temperature in the conduit 8 will be transmitted through the plate 18 to the surface 17, melting the frost formed on the surface 17. That is to say, in a refrigeration system defrosted by reverse cycle defrost, the system fan is not operated, and hot gas from the compressor melts the accumulated frost or ice on the evaporator coil 6. When the detector 2 is located between the expansion device 5 and the evaporator coil 6, the coil 6 is defrosted before the detector 2 is defrosted, and the coil 6 necessarily is free from frost upon activation of the normal refrigeration cycle. Melting of the frost on the surface 17 has the effect of washing the surface and the condensate is permitted to drain downwardly through the outlet 12 of the housing. As indicated, frost removal from the surface 17 is dependent on the thermal path between the conduit 8 and the surface 17 provided by the target plate 16. Consequently, defrost of the surface 17 necessarily will lag behind defrost of the coil 6 so that the defrost cycle for the system 1 is not terminated until the coil 6 is free of frost, even when the alternative positions of the detector 2 are utilized. As indicated above, use of the same detector to initiate and terminate the defrost cycle is another important difference between my invention and other known prior art devices. Frost removal from the surface 17 disables the detector 28 and the system 1 reverts back to its normal operational cycle. The slight lag between the temperature of the target 16 and coil 6 in defrost is not an important consideration in normal operation because of the longer time period for system stabilization. Consequently, as previously described, the target 16 is able to operate at a temperature very near that of the coil 6 for frost accumulation purposes.

It thus may be observed that a frost detector economical in design and simple in operation is provided which meets all the ends and objects herein set forth.

Numerous variations, within the scope of the appended claims, will be apparent to those skilled in the art in light of the foregoing description and accompanying drawings. Thus, while relatively simple adjustment means for varying air flow and temperature in the test portion 13 of the passageway 10 is described, more complicated devices may accomplish similar results and such devices are compatible with the broader aspects of this invention. The design of the housing 9, location of the inlet and outlet, and location of the control means may be varied. Likewise, particular components described in conjunction with the detector 2 illustrated in the drawings may be changed in other embodiments of this invention. These variations are merely illustrative.

Having thus described the invention, what is claimed and desired to be secured by Letters Patent is:

1. A frost detector for a refrigeration device having an evaporating coil, comprising:

a housing, said housing having a light impervious passageway through it, said housing including at least one side wall partially defining said passageway, said side wall having an opening in it;

a thermal conductive means mounted in said opening, said conducting means having a first surface area closing the opening in said passageway, and a second surface area;

an energy source operatively mounted to said housing, said energy source being adapted to illuminate the first surface area of said thermal conducting means;

an energy sensitive device operatively mounted to said housing to sense the level of energy reflected from said thermal conductive means;

means for mounting said housing to a refrigerant carrying portion of said refrigeration device along the second surface of said thermal conducting means, the thermal resistance between the second surface of said thermal conducting means and the refrigerant carrying portion of said refrigeration device being adjustable to vary the heat transfer characteristic of said thermal conducting means; and means for operatively connecting said light impervious passageway to a source of air, said connecting means being positioned so that the air pressure drop across said evaporating coil forces air through said light impervious passageway.

2. The detector of claim 1 further characterized by means for varying the thermal resistance between the second surface of said thermal conducting means and the refrigerant carrying portion of said refrigeration device, said thermal resistance varying means comprising a material having a thermal resistance different from the thermal resistance of said thermal conductive means, said varying means being placed between the refrigerant carrying portion of said refrigeration device and the second surface of said thermal conductive means.

3. The detector of claim 2 wherein said evaporating coil is further characterized by a refrigerant carrying coil having an inlet, a main body portion, and an outlet, the connecting means of said frost detector being operatively connected to said refrigeration device along one of the inlet, the main body portion, and the outlet of said condensing coil.

4. The detector of claim 3 further characterized by means for adjusting air flow through said light impervious passage, said adjusting means including means for restricting the size of said light impervious passage.

5. The detector of claim 4 wherein the second surface of said thermal conducting means has a groove formed in it for engaging the refrigerant carrying portion of said refrigeration device.

6. A frost detector for a refrigeration device having a coil for circulating a refrigerant, which comprises:

a housing, said housing including an enclosure having an inlet, an outlet and an air passageway between said inlet and said outlet;

means for adjusting air flow through said light impervious passage by restricting the air passageway at said inlet;

thermal conductive means mounted in said enclosure, said thermal conductive means having a first surface area exposed in said air passageway, and a second surface area;

an energy source operatively mounted to said housing, said energy source adapted to illuminate the first surface area of said thermal conductive means;

an energy sensitive device operatively mounted to said housing, said energy sensitive device adapted to sense the level of energy reflected from said thermal conductive means;

means for mounting said sensor to a refrigerant carrying portion of said refrigeration device along the second surface of said thermal conductive means; and means for directing an air flow through said air passageway and along the first surface of said conductive means.

7. The detector of claim 6 wherein said air passageway is impervious to external light.

8. The detector of claim 7 wherein said air directing means is positioned so that the air pressure drop across the coil of said refrigeration device forces air through said air passageway.

9. The detector of claim 8 further characterized by means for varying the thermal contact between the second surface of said thermal conducting means and the refrigerant carrying portion of said refrigeration device.

10. The detector of claim 9 wherein the coil of said refrigerating device has an inlet, a main body portion and an outlet, the mounting means of said detector being operatively connected to said refrigeration device along one of the inlet, the main body portion, and the outlet of said condensing coil.

11. In a refrigeration device having an evaporating coil, said coil having a refrigerant carrying part including an inlet, an outlet and a main body portion, the improvement which comprises detector means for initiating a defrost cycle by sensing frost formation and for terminating the defrost cycle upon removal of frost, said detector means comprising a housing, said housing including an enclosure having an inlet, an outlet, and an air passageway between said inlet and said outlet, thermal conductive means having a first surface area exposed in said air passageway and a second surface area, a light source operatively mounted to said housing, said light source adapted to illuminate said first surface area, a light sensitive device operatively mounted to said housing, said light sensitive device being adapted to sense the level of light reflected from said thermal conductive means, means for mounting said sensor to a refrigerant carrying portion of said refrigeration device along the second surface of said thermal conductive means, means for directing an air flow through the air passageway of said housing, means responsive to said light sensitive device for initiating a defrost cycle upon the formation of a predetermined amount of frost on the first surface area of said thermal conductive means, and for terminating the defrost cycle upon removal of a predetermined amount of frost from the first surface area of said thermal conductive means, and means for adjusting the frosting conditions of said thermal conductive means independently of said refrigeration device.

12. The improvement of claim 11 wherein said adjusting means comprises means for varying thermal contact between the second surface of said thermal conducting means and the refrigerant carrying portion of said refrigeration device; and means for adjusting air flow through said light impervious passageway.

13. The improvement of claim 12 wherein said air flow adjusting means comprises means for altering the size of the inlet of said enclosure.

14. The improvement of claim 13 wherein the means for varying thermal contact comprises a material placed between the refrigerant carrying portion of said refrigeration device and a second surface of said thermal conductive means, said material having a thermal resistance different from the thermal resistance of said thermal conductive means.

* * * * *